United States Patent [19]

Langenhorst

[11] Patent Number: 4,998,381

[45] Date of Patent: Mar. 12, 1991

[54] INSPECTION COVER ARRANGEMENT

[76] Inventor: Günter Langenhorst, Kirchstrasse 2, D-4772 Bad Sassendorf 4, Fed. Rep. of Germany

[21] Appl. No.: 439,264

[22] Filed: Nov. 20, 1989

[30] Foreign Application Priority Data

Nov. 24, 1988 [DE] Fed. Rep. of Germany ..... 3839673

[51] Int. Cl.[5] ..... E06B 3/32

[52] U.S. Cl. ..... 49/463; 49/465; 49/469; 49/504

[58] Field of Search ..... 49/463, 465, 469, 485, 49/504; 52/455, 457, 458, 211, 212

[56] References Cited

U.S. PATENT DOCUMENTS

| | | | |
|---|---|---|---|
| 2,559,764 | 7/1951 | Goldberg | 49/485 |
| 2,727,596 | 12/1955 | Smith | 49/463 |
| 3,107,759 | 10/1963 | Day et al. | 52/212 |
| 3,654,734 | 4/1972 | Lehman | 52/212 X |
| 4,160,421 | 7/1979 | Heinen | 49/485 X |
| 4,299,059 | 11/1981 | Smith | 49/485 X |
| 4,307,543 | 12/1981 | Schulthess | 49/504 X |
| 4,674,248 | 6/1987 | Hall | 49/504 X |
| 4,913,127 | 4/1990 | Dugger | 49/463 X |

FOREIGN PATENT DOCUMENTS

| | | | |
|---|---|---|---|
| 2934129 | 3/1980 | Fed. Rep. of Germany | 52/211 |
| 3538757 | 5/1987 | Fed. Rep. of Germany . | |
| 86/04108 | 7/1986 | World Int. Prop. O. | 52/455 |

*Primary Examiner*—Gary L. Smith
*Assistant Examiner*—Jerry Redman
*Attorney, Agent, or Firm*—Toren, McGeady & Associates

[57] ABSTRACT

An inspection cover arrangement with an inspection mounting and an inspection cover, the inspection mounting including frame sections of aluminum, and the inspection cover having cover sections of aluminum is disclosed. The frame sections are so-to-speak reinforced by steel backup retaining sections and overlapping steel corner angles. The cover sections are reinforced by steel backup sheet strips and overlapping steel corner angles, so that in case of exposure to flame action a steel skeleton remains in place for the inspection mounting as well as for the inspection cover, even if the aluminum sections melt down. Because of this the inspection cover arrangement is distinguished by high resistance to fire or by a long period during which it resists the action of fire.

13 Claims, 3 Drawing Sheets

INSPECTION COVER ARRANGEMENT

BACKGROUND OF THE INVENTION

The invention is directed to an inspection cover arrangement with an inspection frame for installation in walls or ceilings, with an inspection plate insertable into the inspection mounting opening and with at least one snap-in lock for the inspection cover on the rear side of the inspection frame and inspection cover. The inspection frame is comprised of a frame section of aluminum or another material with a melting temperature lower than that of steel. Within the scope of the invention it is basically also possible to utilize a lock other than a snap-in lock, for instance a casement lock.

Components enclosing space volumes must be characterized by adequate resistance against fire and heat according to current standards. Not only walls and ceilings fall under such component items, rather under specific assumptions also inspection covers for wall and ceiling installation. The behavior of such components in fire is among other things defined by the fire resistance time period, meaning the passage of the flame must be prevented for a predetermined time span. In fire retarding components the fire resistance duration must amount to at least 30 minutes, in fireproof components it must amount to at least 90 minutes. Inspection covers of the previously described type (compare DEOS 35 38 757) do not easily satisfy such requirements dealing with fire integrity. Actually, the resistance against flames when subjected to a fire is inadequate, especially if the frame section consists of aluminum or another material, whose melting temperature lies below that of steel. One might consider fabricating the frame sections from steel, however aluminum is lighter in weight and can be processed to closer dimensions. In addition, the existing fabrication jigs and especially the tools, are laid out for processing of aluminum. The invention proceeds from this state of affairs.

SUMMARY OF THE INVENTION

Accordingly, it is an object of the present invention to provide an inspection cover of the previously described type, which when subjected to flames has an adequate fire resistance.

Pursuant to this object, and others which will become apparent hereafter, one aspect of the present invention resides in the frame section of the inspection cover mounting being backed up by a retaining section of steel and overlapped by corner angles of steel at least in the region of the frame corners. Alternatively, the frame section can be overlapped by the retaining section and backed up by the corner angles. Additionally, the steel retaining section and the corner angles are connected with each other so that the connector passes through the frame section of the inspection frame or mounting. The invention proceeds from the knowledge that the frame section of the inspection mounting of aluminum can be so-to-speak reinforced by a comparatively thin steel covering of on the one hand a retaining section and on the other hand corner angles. This steel reinforcement assures that the inspection frame or mounting is distinguished by an optimum fire resistance if subjected to flames. Because, even if the frame section of the inspection mounting of aluminum were to melt down, the steel skeleton framework remains in existence.

Herein the essential advantages achieved by the invention are to be found.

In additional embodiments of the invention the retaining section is a peripherally extending angle section with a reinforcement leg backing the frame section of the inspection mounting and with a connection leg bent off at an angle. The connection leg can be connected to a steel support construction, for instance it can be bolted on or suspended thereon. In this connection the connecting leg comprises, expediently, a U-shaped bend-off for overlapping of a hook-on section of a support construction for a suspendable false ceiling, in a ceiling installation. In a wall installation this can mean another overlapping steel section.

In a further embodiment of the invention, with independent significance, the frame section of the inspection mounting is backed up by a retaining section of steel and is overlapped by corner angles of steel at least in the region of the mounting corners or, in reverse, is overlapped by a retention section and backed up by the corner angles. The steel retention section and the corner angles are connected with each other by connectors passing through the frame section of the inspection mounting. The inspection cover also comprises a frame section of aluminum or another material with a melting temperature lower than that of steel, wherein at least one insulating board is connected to this frame section. A steel plate or steel sheet strips are arranged between the frame section of the inspection cover and the insulating board, and the frame section of the inspection cover is overlapped by corner angles of steel at least in the region of the cover corners. The steel plate or the steel plate strips and the steel corner angles of the inspection cover are connected to each other by connectors passing through the frame section of the inspection cover. Steel bolts, rivets or the like can be used as connection elements just as is the case with the inspection mounting or frame. Even a panel of gypsum can be utilized as an insulating board or filling plate, it is however also possible to utilize plates made of mineral fiber. The steel plate or the steel sheet strip at the same time take care of stabilizing the insulating board.

Preferably, the corner angles of the inspection cover are designed as hinged angle clips on the sides opposite to the snap-in lock. For this purpose the corner angles comprise a hinged leg angled outward, which lies loosely upon the inspection mounting. A comparatively simple and functional hinge for the inspection cover is realized in this manner, which additionally enables a selective unhinging of the inspection cover.

The invention features additionally that the snap-in lock consists of steel and comprises two fastening webs, one of which is connected, or for instance bolted, through the frame section of the inspection mounting with the retaining section backing up this frame section. The other web is connected or bolted through the frame section of the inspection cover with the steel plate or steel sheet strips backing up the frame section. Thus, a perfect attachment of the retaining section concerned is achieved not only in the corner region but also in the middle frame or cover region.

Independently of such a steel snap-in lock, the inspection cover can, according to another embodiment of the invention, comprise on its rear side an extendable leaf spring at least in the region of a steel corner angle, which is held back in its initial position by means of a melting fuse lock and when the fuse lock has melted extends itself above the corner angle of the inspection mounting concerned. Leaf springs and fuse melt locks can also be utilized in several corner regions.

It is always achieved that the inspection cover is satisfactorily held in the inspection mounting when subjected to flame action, so that it does not swing open. To that extent the leaf spring constitutes a safety for the inspection cover which is additional to that provided by the snap-in lock. In order to at least considerably retard the melt-down of the frame section of aluminum of the inspection mounting on the one hand and the inspection cover on the other hand, a peripheral sealing section exists for sealing the gap between the inspection mounting and the inspection cover, which sealing section swells when subjected to heat. Thus, in case of flame action, to begin with hot air passage through the peripheral gap between the inspection mounting and the inspection cover is prevented because of the differing pressure condition arising in case of fire above and below the inspection covering. From this again there results a delayed temperature increase due to convection between the frame sections of the inspection mounting and the inspection cover. Only when subjected to an extreme temperature increase does the sealing section, which to begin with, completely seals the gap between the inspection mounting and inspection cover and which swells at approximately 190° C., completely burn up.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DETAILED DESCRIPTION OF THE PREFERRED EMBODIMENTS

Figure 1:
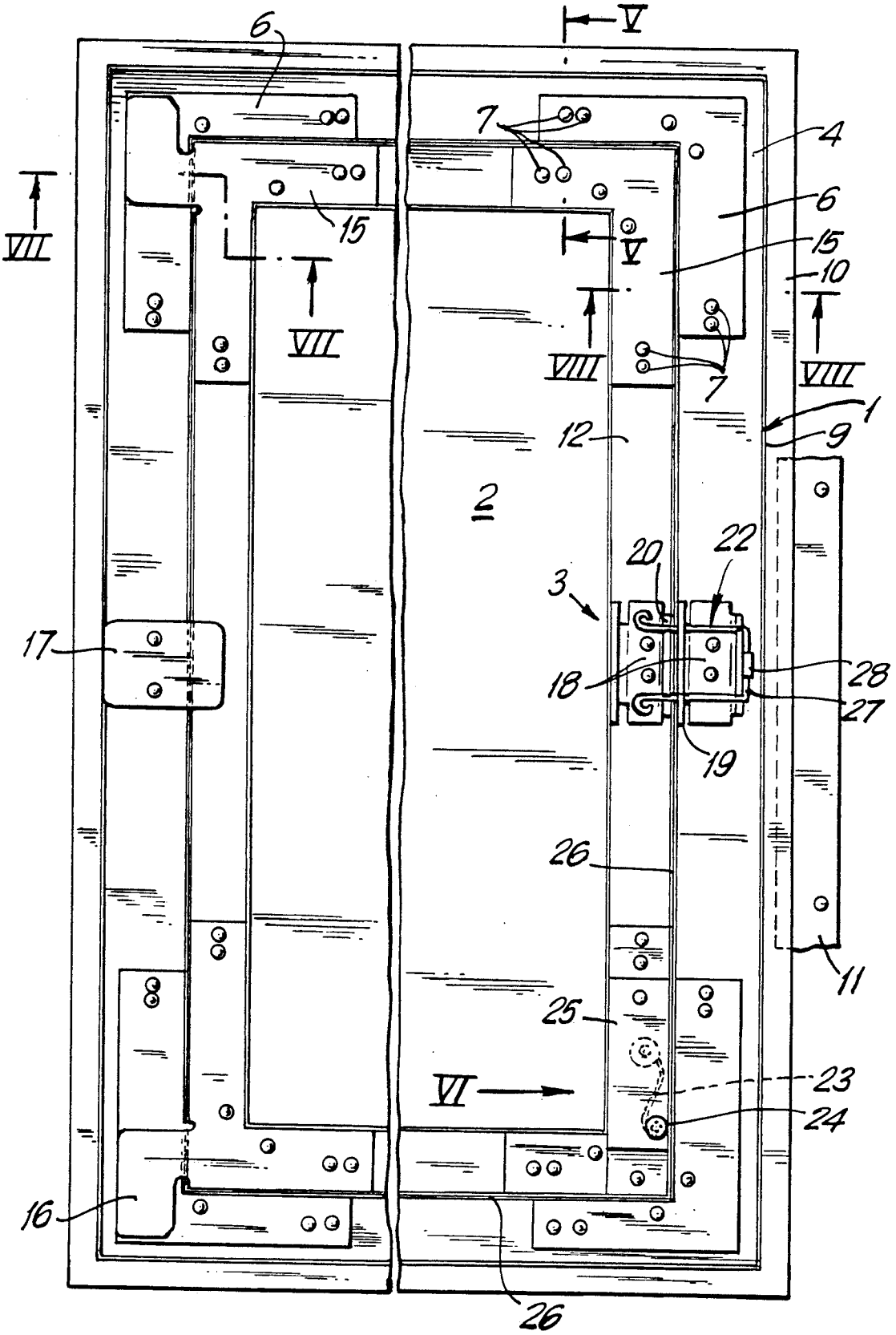
FIG. 1 shows an inspection covering pursuant to the present invention in top view upon its rear side with a connecting section for installation in a ceiling indicated thereon.
Figure 2:
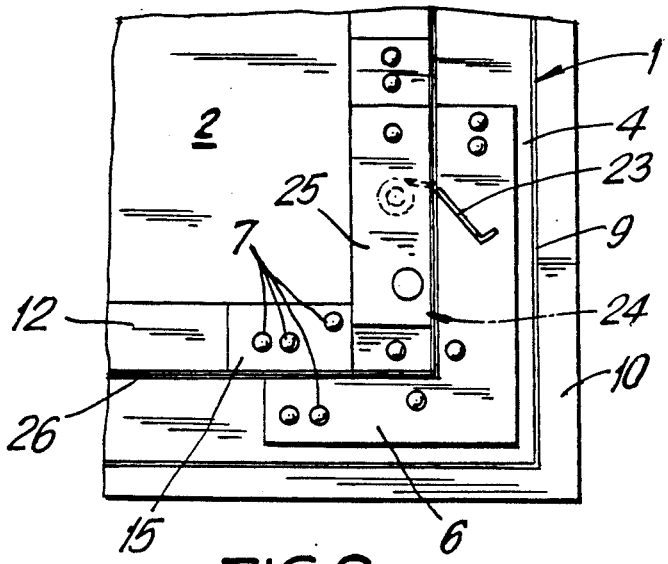
FIG. 2 shows a cutout of the covering in FIG. 1 after being subjected to the effect of flames.
Figure 3:
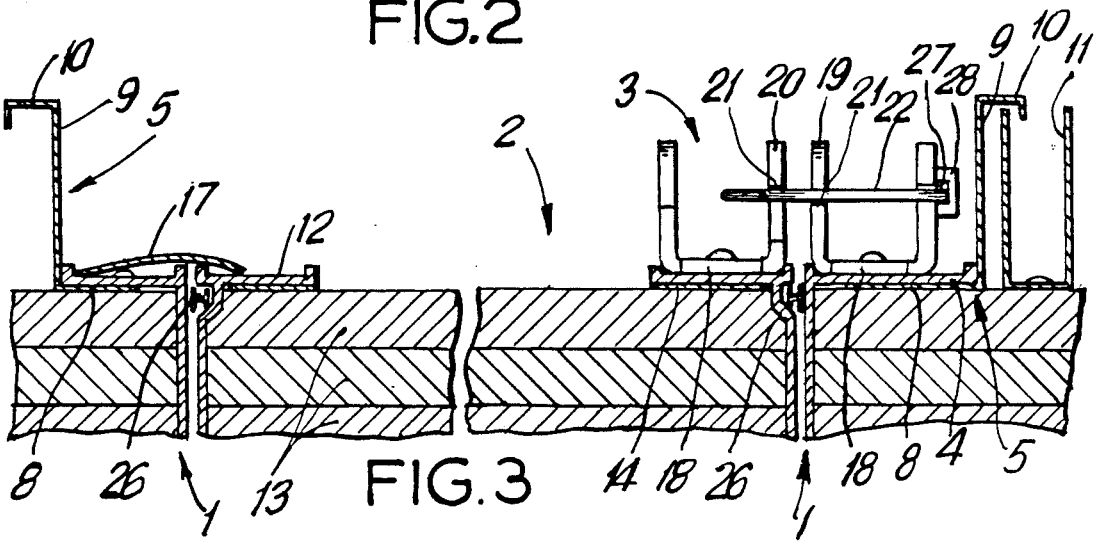
FIG. 3 is a cross-section through the covering in FIG. 1.
Figure 4:
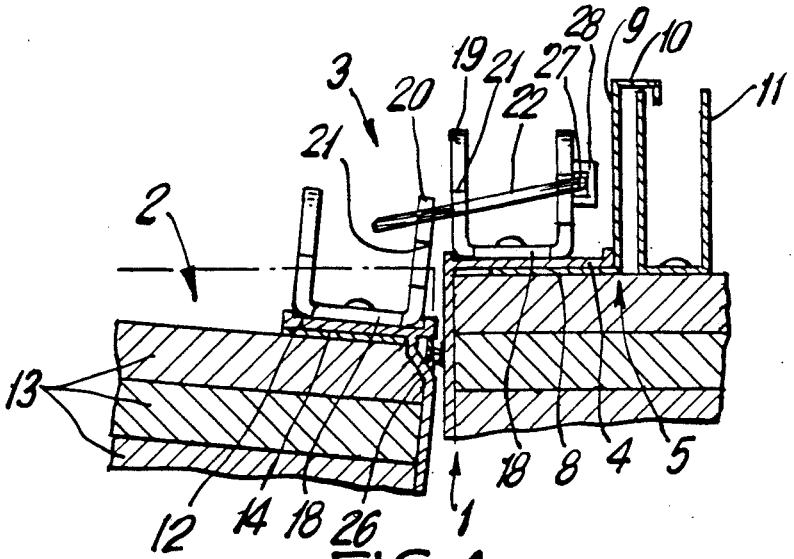
FIG. 4 is a cutout from the view in FIG. 3 with an indication of the inspection cover being open.
Figure 5:
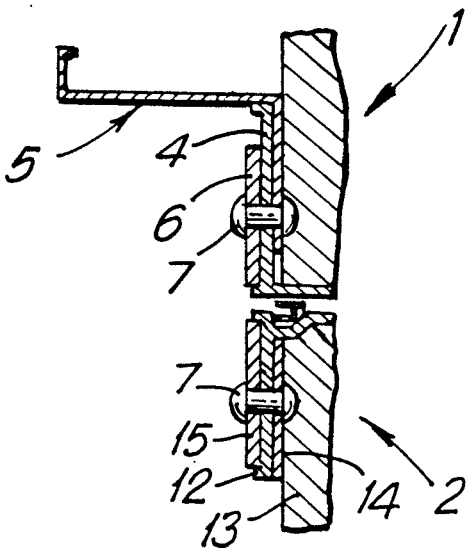
FIG. 5 is a section along the line V—V in FIG. 1.
Figure 8:
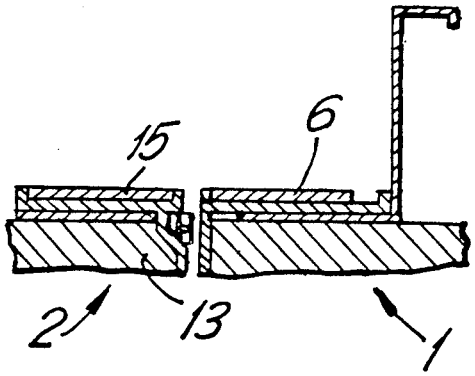
FIG. 8 is a section along the line VIII—VIII in FIG. 1.

An inspection covering arrangement is depicted in the figures, which in its basic structure comprises an inspection mounting or frame 1 for installation in walls or ceilings and an inspection cover 2 insertable into the inspection mounting 1 with at least one snap-in lock 3 for the inspection cover 2 on the rear side of the inspection mounting 1 and inspection cover 2. The inspection mounting or frame 1 has an aluminum frame section 4 constituting the external frame for the frame 1. The frame section 4 is backed up by a steel retaining section 5 and overlapped by steel corner angles 6 at least in the region of the frame corners as shown in FIG. 8. The steel retaining section 5 and the corner angles 6 are connected with each other by connectors passing through the frame section 4 of the inspection mounting 1, for instance by means of steel bolts 7 or steel rivets as shown in FIG. 5. The retaining section 5 is designed as a peripheral angle section with a reinforcement leg 8 backing up the frame section 4 of the inspection mounting, and a bent-off connection leg 9. The connection leg 9 is bent off in a U-shaped manner 10 for overlapping of an indicated connection or suspension section 11 of a support construction for a suspended false ceiling.

Figure 7:
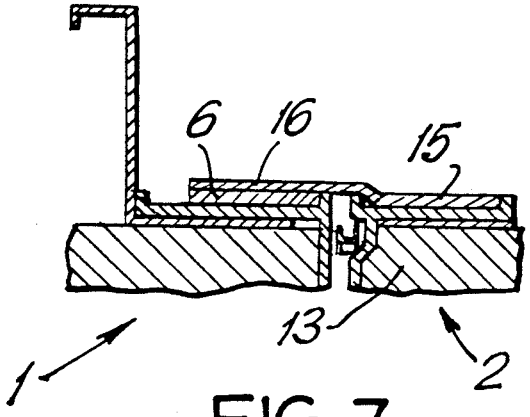
FIG. 7 is a section along the line VII—VII in FIG. 1.

The inspection cover 2 comprises an aluminum frame section 12 forming the inner frame for connection of at least one insulating board 13. Steel sheet strips 14 are arranged between the frame section 12 of the inspection cover 2 and the insulating board 13. The frame section 12 of the inspection cover 2 is overlapped by steel corner angles 15 at least in the region of the cover corners. The steel sheet strips 14 and the steel corner angles 15 are connected with each other by connectors passing through the frame section 12 of the inspection cover 2, also by means of steel bolts 7 or steel rivets. The corner angles 15 are configured as hinged angles on the side lying opposite to the snap-in lock 3. For this purpose the hinged angles 15 comprise a bent-off hinge leg 16, which lies loosely upon the inspection frame or mounting 1 as shown in FIG. 7. The inspection mounting 1 can comprise in the middle region between the two hinged angles a hold-down device 17 overlapping the inspection cover 2 possibly with spring action.

Figure 6:
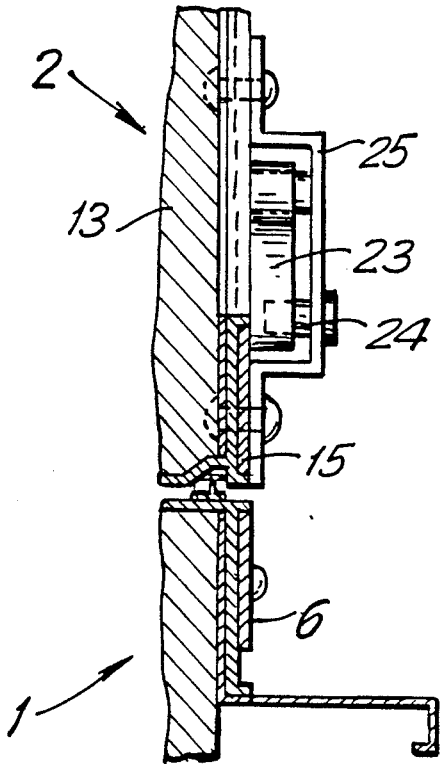
FIG. 6 is a section indicated by the arrow VI in FIG. 1.

The snap-in lock 3 consists of steel and comprises an attachment web 18 overlapping respective frame sections 4 or 12 of the inspection mounting 1 and of the inspection cover 2. Furthermore, the lock 3 comprises a retaining lug 19 at the inspection mounting 1 and a snap-in tongue 20 at the inspection cover 2. The retaining lug 19 and the snap-in tongue 20 protrude at right angles from the mounting or cover plane and comprise aligned snap-in constrictions 21 at their flanks. With this formation, on the one hand, of abutment shoulders at the retaining lug 19 and, on the other hand, hang-in shoulders at the snap-in tongue 20, the flexural legs of a snap-in spring 22 supported at the inspection mounting 1 in a plane parallel thereto can snap into the snap-in constrictions. The respective retention section 5 at the respective steel sheet strip 14 are additionally connected with the attachment web 18 by connectors passing through the frame section 4 or 12 of the inspection mounting 1 or of the inspection cover 2. The inspection cover 2 comprises on its rear side, as shown in FIG. 6, an extendable leaf spring 23 in the region of at least one steel corner angle 15, which leaf spring is retained in a housing 25 in its initial position by means of a melting fuse lock 24 and, if the melting fuse lock 24 has melted, extends itself over the respective corner angle 6 of the inspection mounting 1. This achieves, apart from the snap-in lock 3, an additional retention of the inspection cover 2 against swinging open if exposed to flame action.

The frame section 4 or 12 of the inspection mounting 1 or of the inspection cover 2 has a peripheral sealing section 26 for sealing the gap between the inspection mounting 1 and the inspection cover 2. This sealing section 26 swells because of heat generation if exposed to flame action; finally, however, it is consumed by combustion. In any case by sealing the gap a melt down of the aluminum section because of passage of hot air is delayed.

The snap-in lock 3 comprises a U-shaped snap-in spring 22 and a retaining lug 19 at the inspection mounting 1 and a snap-in tongue 20 at the inspection cover 2. The U-shaped snap-in spring 22 is pivotably supported with respect to the cover plane by its U-web 27 at a support block 28 projecting at right angles from the inspection mounting 1.

The invention covers also an inspection covering arrangement with a round inspection mounting and cover While the invention has been illustrated and described as embodied in an inspection cover arrangement, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by letters patent is set forth in the appended claims:

1. An inspection cover arrangement, comprising: an inspection frame (1) installable in a wall or a ceiling; an inspection cover (2) insertable into the inspection frame (1); at least one snap-in lock (3) for the inspection cover (2) arranged on a rear side of the inspection frame (1) and the inspection cover (2), the inspection frame (1) including a frame section (4) of a material with a melting point lower than that of steel; a steel retention section (5) arranged so as to back up the frame section (4) of the inspection frame (1); steel corner angles (6) arranged at least in a region of a corner of the frame so as to overlap the frame section (4), so that the retention section (5) backs up the frame section (4) when the corner angles (6) overlap the frame section (4); and means for connecting the steel retention section (5) and the corner angles (6) with each other, the connecting means passing through the frame section (4) of the inspection frame (1).

2. An inspection cover arrangement according to claim 1, wherein the retention section (5) is formed as a peripheral angle section with a reinforcing leg backing up the frame section (4) of the inspection frame (1), and a bent-off connecting leg (9).

3. An inspection cover arrangement according to claim 2, wherein the connecting leg (9) has a U-shaped bend-off (10) arranged so as to overlap an adjacent member (11) of the wall or ceiling.

4. An inspection cover arrangement according to claim 1, wherein the frame section (4) is made of aluminum.

5. An inspection cover arrangement, comprising: an inspection frame (1) installable in a wall or a ceiling; an inspection cover (2) insertable into the inspection frame (1); at least one snap-in lock (3) for the inspection cover (2) arranged on a rear side of the inspection frame (1) and the inspection cover (2), the inspection frame (1) including a first frame section (4) of a material with a melting point lower than that of steel; a steel retention section (5) arranged so as to one of back up the first frame section (4) of the inspection frame (1); steel corner angles (6) arranged at least in a region of a corner of the frame so as to overlap the first frame section (4), and the retention section (5) backs up the first frame section (4) when the corner angles (6) overlap the first frame section (4); means for connecting the steel retention section (5) and the corner angles (6) with each other, the connecting means passing through the first frame section (4) of the inspection frame (1), the inspection cover (2) including a second frame section (12) of a material with a melting temperature lower than that of steel; at least one insulating board (13) being connected to the second frame section (12); steel sheet strips (14) arranged between the second frame section (12) of the inspection cover and the insulating board (13); further corner angles (15) arranged so as to overlap the second frame section (12) of the inspection cover (2) at least in a region of the cover corners; and a second connecting means for connecting steel sheet strips (14) and the further corner angles (15) of the inspection cover with each other, the second connecting means passing through the second frame section (12) of the inspection cover.

6. An inspection cover arrangement according to claim 5, wherein the further corner angles (15) of the inspection cover (2) are formed as hinge angles on a side lying opposite to the snap-in lock (3).

7. An inspection cover arrangement according to claim 5, wherein the snap-in lock (3) is made of steel and comprises two attachment webs (18), one of the webs being connected through the first frame section (4) of the inspection mounting (1) with the retention section (5) backing up the first frame section (4), and the other of the attachment webs (18) being connected through the second frame section (12) of the inspection cover (2) with the steel plate or steel sheet strips (14) backing up the second frame section (12).

8. An inspection cover arrangement according to claim 5, and further comprising an extendable leaf spring (23) arranged on the rear side of the inspection cover (2) at least in the region of the further corner angle (15), and a melt fuse lock (24) arranged so as to hold the spring in an initial position, the melt fuse lock (24) being meltable so as to permit the spring to extend over the respective corner angle (6) of the inspection mounting (1).

9. An inspection cover arrangement according to claim 1, and further comprising a peripheral sealing member (26) arranged so as to seal a gap between the inspection frame (1) and the inspection cover (2), which sealing member swells when subjected to heat.

10. An inspection cover arrangement according to claim 1, wherein the snap-in lock (3) comprises a U-shaped snap-in spring (22) and a retaining lug (19) at the inspection frame (1), and a snap-in tongue (20) at the inspection cover (2).

11. An inspection cover arrangement according to claim 10, wherein the U-shaped snap-in spring (22) is supported by its U-shaped web (27) at a bearing block (28) arranged so as to protrude at a right angle from the inspection frame (1) and so as to be pivotable against the cover plane.

12. An inspection cover arrangement according to claim 5, wherein the first frame section (4) and the second frame section (12) are made of aluminum.

13. An inspection cover arrangement according to claim 5, and further comprising a peripheral sealing member (26) arranged so as to seal a gap between the inspection frame (1) and the inspection cover (2), which sealing member swells when subjected to heat.

* * * * *